US005686890A

United States Patent [19]

Ko

[11] Patent Number: 5,686,890

[45] Date of Patent: Nov. 11, 1997

[54] DOOR LOCK ALARM

[76] Inventor: Joseph Y. Ko, 12 Morning Dove, Laguna Niguel, Calif. 92677

[21] Appl. No.: 648,873

[22] Filed: May 16, 1996

Related U.S. Application Data

[63] Continuation-in-part of Ser. No. 404,368, Mar. 15, 1995, abandoned.

[51] Int. Cl.[6] ..... G08B 13/08

[52] U.S. Cl. ..... 340/545; 340/542

[58] Field of Search ..... 340/545, 550, 340/566, 546, 541, 665, 693; 200/61.62

[56] References Cited

U.S. PATENT DOCUMENTS

| | | | |
|---|---|---|---|
| 2,436,470 | 2/1948 | Fleming | 340/527 |
| 4,196,422 | 4/1980 | Swigert et al. | 340/545 X |
| 4,360,803 | 11/1982 | Heiland | 340/542 |
| 5,311,168 | 5/1994 | Pease, Jr. et al. | 340/542 |
| 5,469,139 | 11/1995 | Ko | 340/545 |

FOREIGN PATENT DOCUMENTS

| | | | |
|---|---|---|---|
| 2024917 | 1/1980 | United Kingdom | 340/545 |

*Primary Examiner*—Thomas Mullen

*Attorney, Agent, or Firm*—Knobbe, Martens, Olson & Bear, LLP

[57] ABSTRACT

A lock and alarm device for securing a door activates an alarm of 110–120 decibels for approximately 60 seconds if a force on the door exceeding about 20–30 pounds is detected. An arrangement comprising a dead bolt or handle lock assembly includes an alarm unit mounted on a plate adjacent the lock for detecting forced entry.

10 Claims, 4 Drawing Sheets

DOOR LOCK ALARM

RELATED APPLICATION

This application is a continuation-in-part of U.S. application Ser. No. 404,368, filed Mar. 15, 1995 entitled DOOR LOCK ALARM, abandoned.

BACKGROUND OF THE INVENTION

The door lock alarm of the present invention relates generally to the field of home security devices, and, in particular, to a lock and alarm device that is responsive to forced entry through a door.

Security devices for the doorway of a home include simple and inexpensive bolts and locks, as well as more complex and expensive electronic systems. The former can be installed by the homeowner with simple tools and do not require modification of the door or frame. The latter are normally installed by a skilled professional and require modification of the door, the frame and/or surrounding walls.

Door locking devices are often simple cam-type, or rim, locks. A deadbolt unit is typically arranged above the door handle. A dial or a key is turned to extend the bolt from the door into a receiving hole in the door frame. Other simple locks are part of the handle and are operated on the inside by either turning a dial or pressing a button and on the outside by using a key. From the inside, the lock may also be released by simply turning the handle. Door bolts and locks are a small deterrent to intruders capable of either circumventing the devices or breaking them to gain entry. In many areas, the noise from breaking and entering is not heard by neighbors. At best, these devices delay the intruder momentarily.

Additional security for doors is usually obtained by increasing the number of locks or installing an expensive, complicated electronic system. Unfortunately, only the electronic system can usually be depended upon to provide an audible indication of a break-in which is loud enough to be heard by neighbors and passersby. Since the electronic system relies upon an externally available power source, most likely without a battery or generator backup, it is vulnerable to sabotage and power disruptions. Further, a knowledgeable intruder would simply cut off power to the home to completely bypass the security system.

SUMMARY OF THE INVENTION

The door lock alarm of the present invention provides advantages over the previous door locks by comprising a lock assembly and a force sensor with a high output alarm unit. The lock and alarm device is easily installed by the homeowner wherever door locks are presently provided. It is powered by a replaceable battery, so there is no reliance upon an electric power supply which could be disrupted.

In the present invention, a door lock is mounted to the door and the battery-operated alarm unit is mounted on a plate adjoining the lock on the interior side of the door. The device of the present invention may comprise an arrangement having a dead bolt or door handle lock assembly juxtaposed with the alarm unit on the plate. When an ON/OFF switch is set to ON any force on the door exceeding a user-selected amount of force activates an alarm.

In the preferred embodiment, the nominal value is adjustable to between about 10 to 50 pounds and activates an alarm of about 120 decibels. The battery in this embodiment is preferably a 12 volt alkaline or lithium.

Thus, advantages of the present invention include its simple construction and easy installation, its battery operation, its door locking, its adjustable force sensitivity and its high-output alarm. The door lock provides obstruction of the attempted entry and the alarm loudly announces an intruder's presence to persons in the house and nearby.

Further advantages and applications will become apparent to those skilled in the art from the following detailed description and the drawings referenced herein.

DETAILED DESCRIPTION OF THE PREFERRED EMBODIMENT

Figure 1:
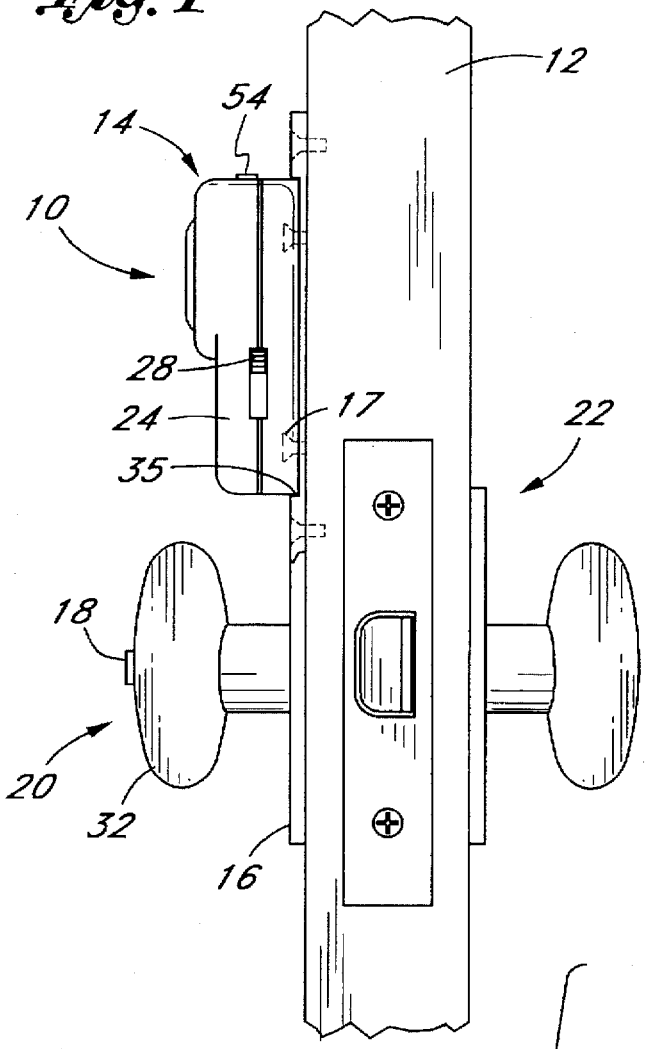
FIG. 1 is a side elevational view of a preferred embodiment of the lock alarm of the present invention illustrating the mounting on an interior side of a door.

A preferred embodiment of a door lock alarm of the present invention is illustrated in FIG. 1, and generally referenced by the numeral 10. The device 10 is mounted on the opening side of a door 12 and comprises an alarm unit 14 juxtaposed on a plate 16 with an actuator 18 for a door lock assembly 20. The lock assembly is the interior-mounting portion of a lock set 22 for the door 12.

An alarm housing 24 is located above the lock assembly 20 on an interior side of the door 12. The alarm housing 24 includes a force sensor 26 and, optionally, a sliding switch 28 for the sensitivity of the sensor 26 as further described below. In alternative embodiments, a panic switch (not shown) can be further provided on the device 10 of the present invention, whereby a user may depress the switch for immediate activation of the alarm unit.

Figure 2B:
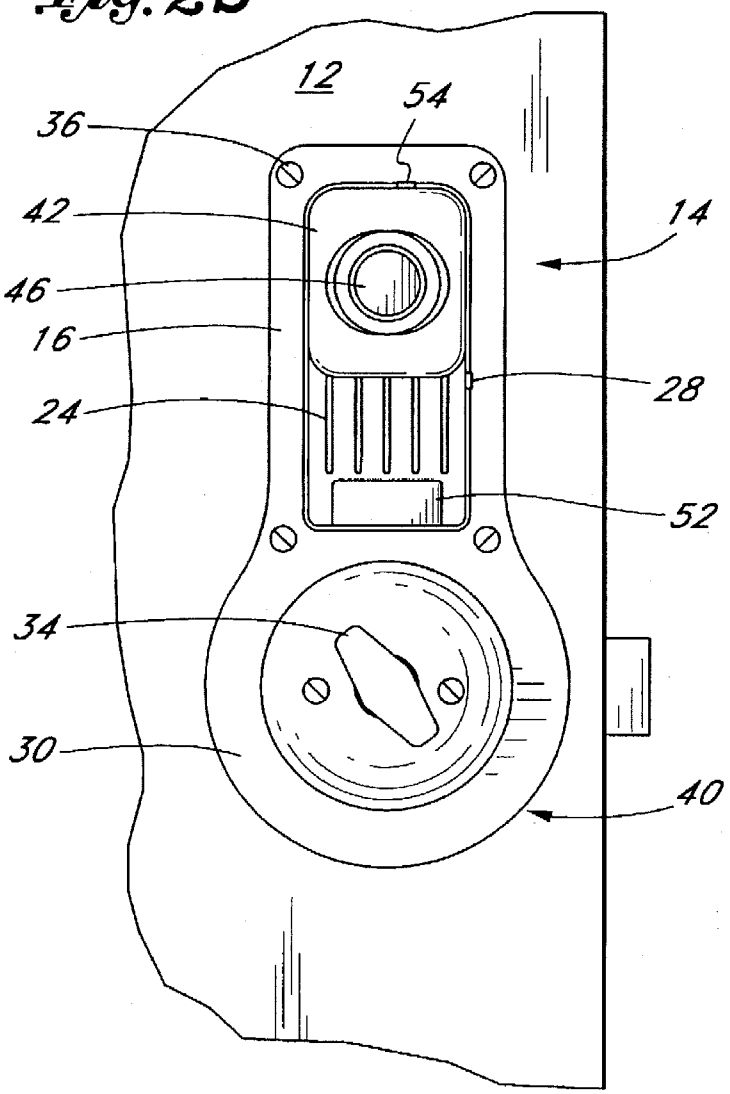
FIG. 2*b* is a front elevational view of an alternative preferred embodiment of the lock and alarm of the present invention.
Figure 2A:
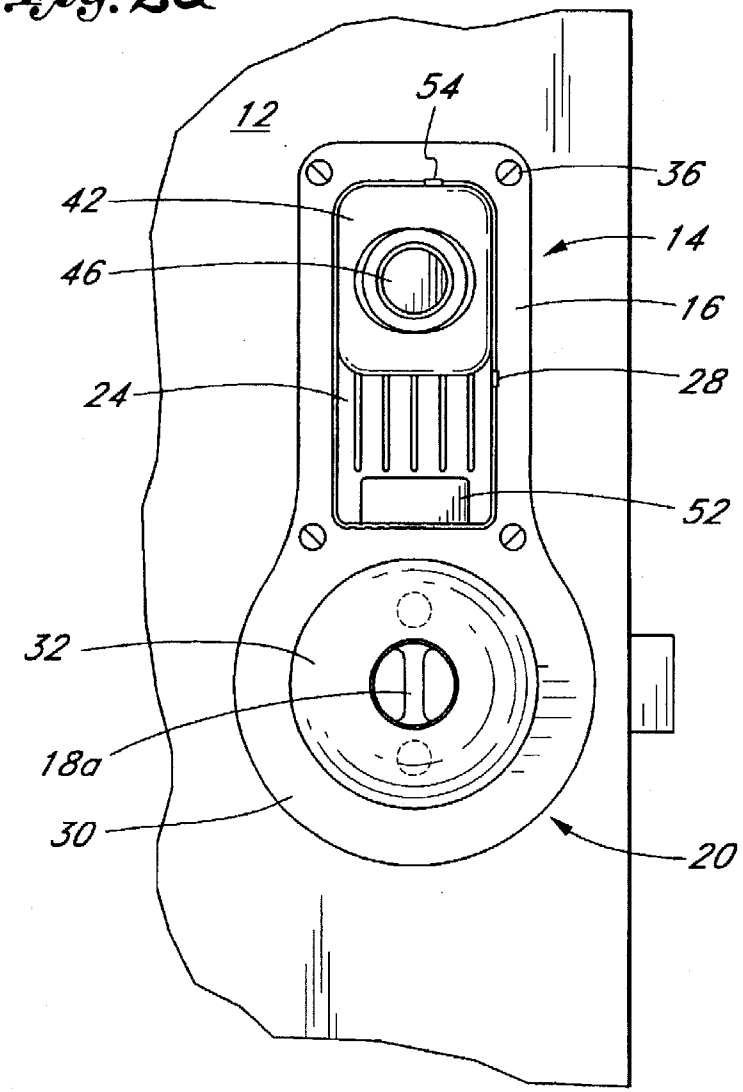
FIG. 2*a* is a front elevational view of the preferred embodiment of FIG. 1, illustrating the mounting of the lock and alarm housing.
Figure 2C:
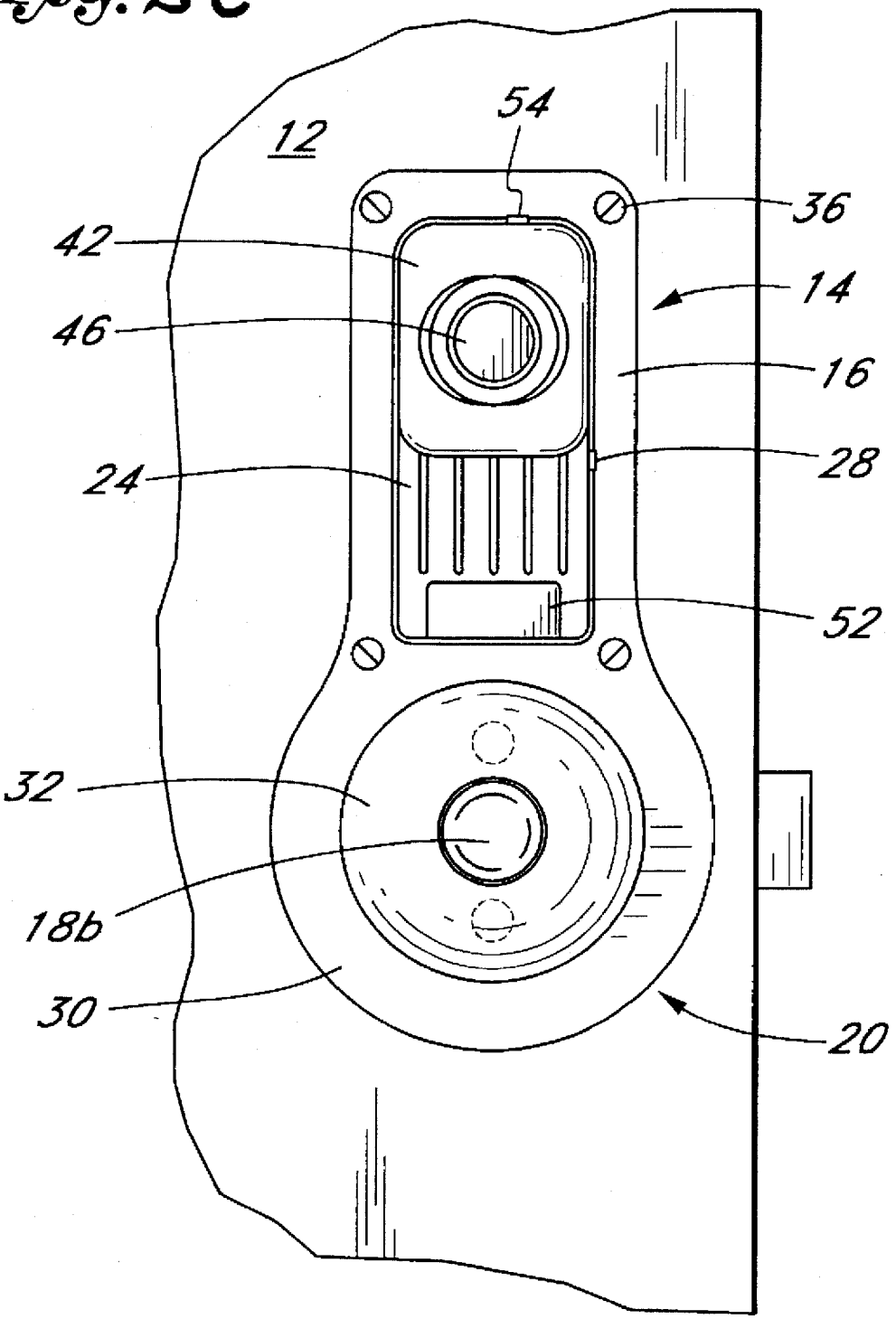
FIG. 2*c* is a front elevational view of another alternative preferred embodiment of the lock and alarm of the present invention.

Referring in detail to the preferred embodiments more clearly illustrated in FIGS. 2*a*, 2*b* and 2*c*, the juxtaposition of the alarm housing 24 with the lock assembly 20 on the plate 16 is shown. As shown in FIGS. 2*a* and 2*c*, the lock assembly 20 is conventionally attached to the plate 16, and the construction of the locking actuator of the handle type lock assembly, either dial actuator 18*a* or button actuator 18*b*, is well known to those skilled in the art and will not be further described herein. The generally rectangular alarm housing 24 may be positioned on the plate to be above, below or horizontally adjacent the lock assembly 20, without loss of the advantages of the present invention. The mounting plate 16 is shown as a substantially flat, generally pear-shaped element, wherein a broader portion 30 corresponds to a conventional, circular base of a door handle 32 or deadbolt switch 34 (FIG. 2*b*). However, it is understood that both the mounting plate 16 and the housing 24 may comprise other shapes, such as ovals, triangles or such. The housing 24 is preferably formed of plastic and may be attached in a recess 35 of the mounting plate 16 by screws 17 or by use of an adhesive. Or, if a metallic housing is utilized, soldering or other means known to those skilled in the art may be employed to attach the housing 24 to the mounting plate 16. The mounting plate 16 is preferably formed of suitable metallic material and should correspond to the material of the lock assembly 20. As illustrated in the drawings, the mounting plate 16 is preferably secured to the door 12 via screws 36; although, other fastening methods may also be employed, such as by welding if the door is metallic. As shown in FIG. 2*b*, an alternative embodiment of the lock alarm of the present invention comprises a lock assembly 40 not including knobs or handles 32 but having a switch-type locking actuator 34. The deadbolt arrangement of FIG. 2*b* may be used above a conventional handle-lock assembly 20 for added security.

Figure 3:
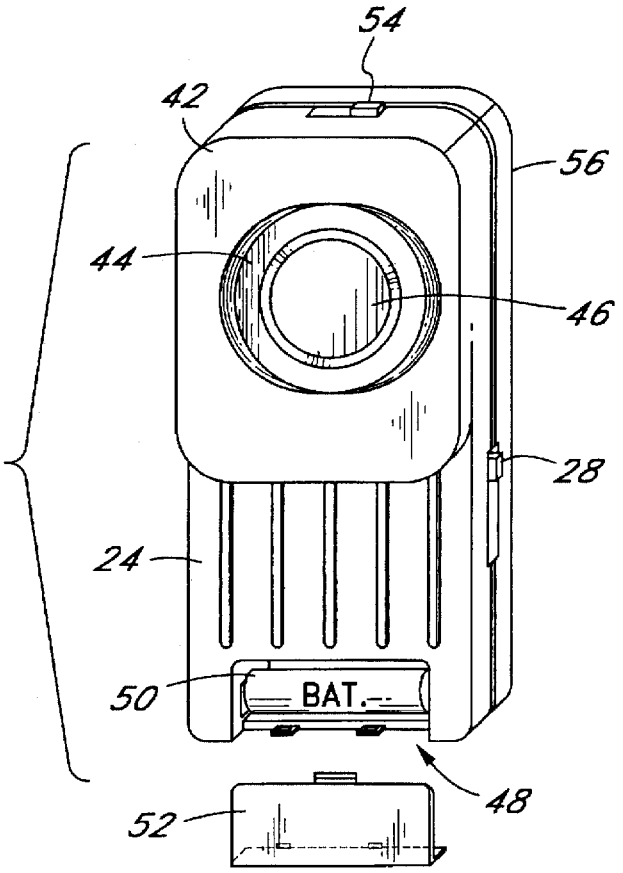
FIG. 3 is a perspective view of a preferred embodiment of a battery-powered alarm unit for mounting adjacent a lock in the present invention.

Referring now in detail to FIG. 3, the alarm housing 24 of the preferred embodiment of the present invention comprises a portion 42 having a circular depression 44 within which is located a raised, circular dome cover 46 for a diaphragm (not shown) of the alarm unit 14. The cover 46 acts as a speaker, where the circular shape aids in dispersing the sound. The diaphragm and its connected leads (not shown) are both contained within the alarm housing 24 as part of the high output alarm unit 14 and are constructed in a manner well known to those skilled in the art. A battery compartment 48 is preferably located on the housing 24 for ready access through its cover 52. The alarm unit 14 is preferably powered by a replaceable, 12 Volt battery 50, either alkaline or lithium. As illustrated schematically in FIG. 4, the battery 50 is electrically coupled/decoupled to the alarm unit 14 and the force sensor 26 by an ON/OFF switch 54. Upon activation, the alarm unit 14 emits an alarm sound of at least about 110 decibels (db), or preferably about 120 db.

The sensor 26 of the device 10 of the present invention is preferably precalibrated by the manufacturer to detect forces within a range of threshold or nominal values, $f_n$, preferably a range including 20–30 pounds, before activation of the alarm unit 14. The sensitivity of the force sensor 26 is adjustable by the user through the sliding switch 28 (FIG. 3) which preferably ranges between a minimum sensitivity of about 50 pounds force to a maximum sensitivity of about 10 pounds force. The method of implementing the adjustable sensitivity is known to those skilled in the art, wherein a piezoelectric type sensor for example, utilizing a piezoelectric crystal unit, may be used for the force detection. Generally, the piezoelectric material is capable of varying its output charge in direct proportion to the stress applied. Alternatively, a bonded strain gage may be used for force detection and comprises an element of known force-strain relationship such that its electrical resistance changes with the applied strain. The sensor 26 is mounted within the alarm housing 24 such that it contacts the inside of a back wall 56 of the housing 24 that attaches to the mounting plate 16.

Figure 4:
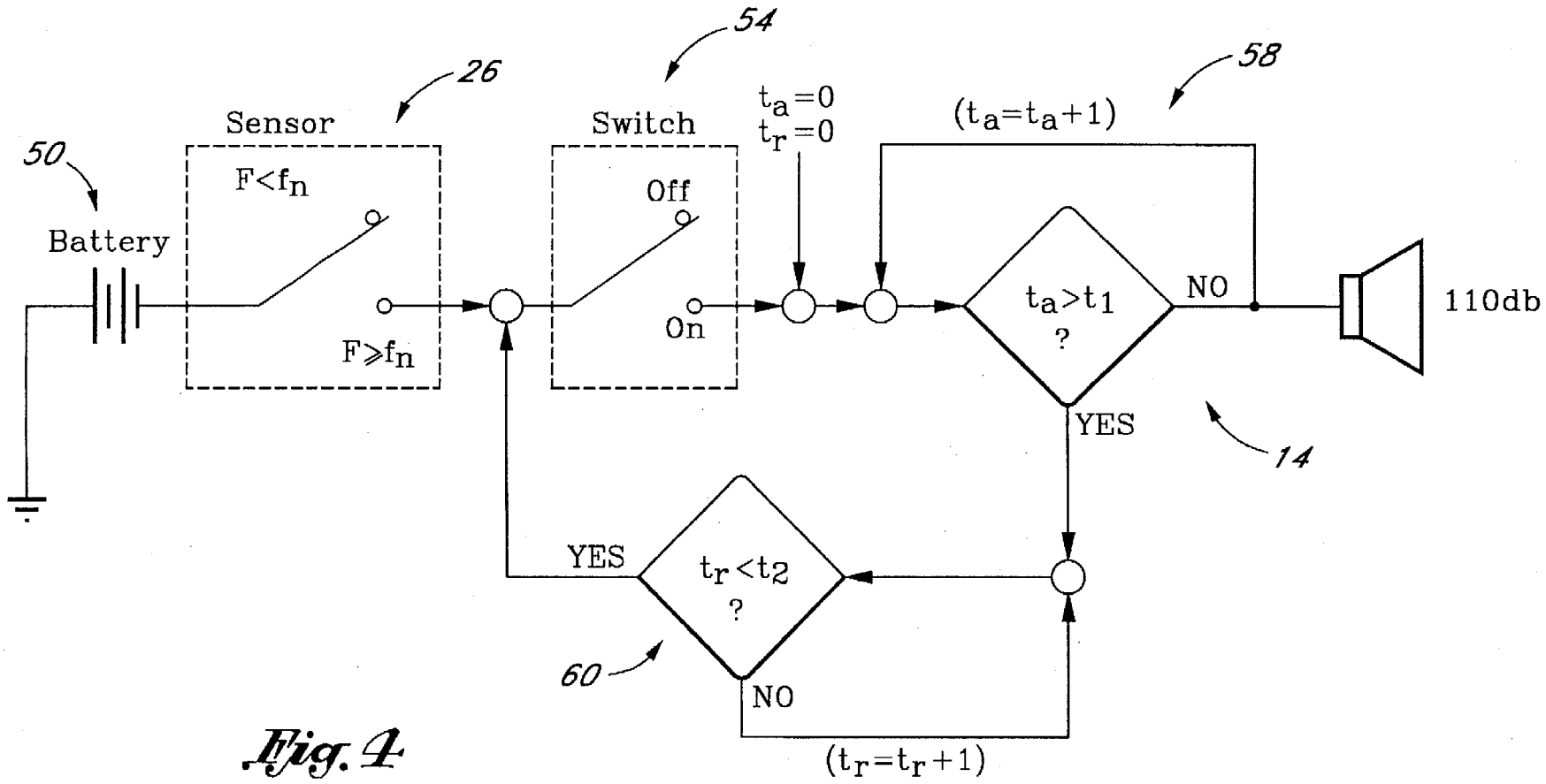
FIG. 4 is a simplified schematic of the operation of the lock and alarm of the present invention.

A simplified schematic of the door lock alarm 10 of the present invention is illustrated in FIG. 4, illustrating that activation requires a combination of the switch 54 ON setting and force detection. Of course, a viable or charged power source 50 is required for the alarm 14 to function. In a preferred embodiment of the present invention, the alarm sound is emitted for about 60 seconds ($t_1$), and then has a retrigger delay of approximately 3 seconds ($t_2$) before resounding if the ON/OFF switch 54 is not set to OFF. The respective timers $t_a$, $t_r$ 58, 60 of the alarm unit 14 may be simple counters or other mechanisms well known to those skilled in the art. It is understood that other times may be utilized for the alarm sounding and retrigger of the alarm unit 14 in the present invention.

The battery-operated door lock alarm 10 of the present invention may be used to back up a more complicated electronic system. The embodiments illustrated and described above are provided merely as examples of the preferred construction of the present invention. Other changes and modifications may be made from the embodiments presented herein by those skilled in the art without departure from the spirit and scope of the invention, as defined by the appended claims.

What is claimed is:

1. A lock alarm device for a door, comprising:

a plate adapted to be mounted on one side of said door;

a housing adapted to be mounted on said plate;

an alarm unit contained within said housing and operated by a battery;

a force sensor for detecting force on said door above a user-selected value, said sensor contained in said housing;

an ON/OFF switch for electrically coupling/decoupling said alarm unit and said sensor from said battery; and a lock assembly having its actuator juxtaposed with said housing on said plate, said lock assembly to be operably coupled to a corresponding assembly on the other side of said door;

wherein said alarm unit is activated when said ON/OFF switch is set to ON and a force greater than said user-selected value is detected.

2. The device of claim 1, wherein said user-selected value of force is selected using a slidable switch.

3. The device of claim 2, wherein said user-selected value of force is within a range of about 10 to 50 pounds.

4. The device of claim 1, wherein said lock assembly comprises a deadbolt switch.

5. The device of claim 1, wherein said lock assembly comprises a door handle having a button locking actuator.

6. The device of claim 1, wherein said lock assembly comprises a door handle having a dial locking actuator.

7. A method of constructing a door lock alarm to be used to secure a door, comprising the steps of:

a) providing a battery-operated alarm unit, a force sensor and a force sensitivity selector in a housing;

b) mounting said housing onto a plate; and c) attaching an interior-mounting lock assembly to said plate such that said housing is juxtaposed with an actuator of said lock assembly.

8. The method of claim 7, wherein step a) further comprises providing a 12 Volt battery and an ON/OFF switch on said housing for selectively coupling said battery to said alarm unit.

9. The method of claim 7, further comprising the step of providing a corresponding assembly of the lock set on the other side of said door, said lock assemblies operably coupled for securing said door.

10. The method of claim 7, wherein step b) comprises mounting said housing to said plate by using screws.

* * * * *